United States Patent [19]

Gass

[11] Patent Number: 4,748,434

[45] Date of Patent: May 31, 1988

[54] TAP OR CURRENT COLLECTOR FOR POTENTIOMETERS, DISPLACEMENT PICK-UPS, ETC.

[75] Inventor: Ernst Gass, Stuttgart, Fed. Rep. of Germany

[73] Assignee: Novotechnik GmbH, Ostfildern, Fed. Rep. of Germany

[21] Appl. No.: 724,085

[22] Filed: Apr. 17, 1985

[30] Foreign Application Priority Data

Apr. 21, 1984 [EP] European Pat. Off. ..... 84104530.5

[51] Int. Cl.[4] ..... H01C 10/38

[52] U.S. Cl. ..... 338/176; 338/137; 338/160; 338/183; 338/202

[58] Field of Search ..... 52/403; 338/176, 183, 338/202, 160, 118, 137; 339/154 R

[56] References Cited

U.S. PATENT DOCUMENTS

| | | | |
|---|---|---|---|
| 4,051,453 | 9/1977 | Barden | 338/202 X |
| 4,118,258 | 10/1978 | Graveron et al. | 52/403 |
| 4,426,635 | 1/1984 | Takezawa | 338/176 |

*Primary Examiner*—R. L. Moses
*Assistant Examiner*—Jane K. Lau
*Attorney, Agent, or Firm*—McAulay, Fields, Fisher, Goldstein & Nissen

[57] ABSTRACT

Tap or current collector for rotary or linear potentiometers, displacement pick-ups, variable resistances, brushes/collector junctions of electric motors, etc., wherein the tapping part on which the slider elements as such are mounted and which performs a relative movement with respect to the tapped path or collector carries the slider elements having individual resilient and freely movable slider fingers, at least in the contact area proper, and which are mounted on a mounting block in such a manner, relative to the sense of displacement, that irrespective of the sense in which the tap moves at any time, one of the slider elements is always pushed, and the other one is always pulled so that even the influences on the tapped or transmitted electric signal of dynamical effects developed by high accelerations are compensated. Further, the individual slider elements are pre-bent along their longitudinal extension so that they follow a pre-determined curve in the inoperative condition and assume a substantially straight shape when applied under resilient pressure to the path to be scanned, whereby the distance between the tap and the path can be minimized.

9 Claims, 1 Drawing Sheet

10
11
13
B
D
C
15
16
14
E
A
12
16a

20
AB
20
11'
11b'
11a'
22
23
24
10'
12a'
12b'
24
23
22
16'

24
26a
25
21
21
10'
26b
24
11'
27b
23
27a
23
23
22
23
22
12a'
12b'

11'
14'
12a'
16'a
12b'

TAP OR CURRENT COLLECTOR FOR POTENTIOMETERS, DISPLACEMENT PICK-UPS, ETC.

DESCRIPTION OF THE PRIOR ART

The present invention starts out from a tap or current collector of the species described in the main claim. It has been known heretofore, in particular in connection with high-precision rotary or linear potentiometers and/or variable resistances, to provide a tap consisting of a pre-determined number of individual slider fingers arranged one beside the other and sliding on the associated path or runway, the slider fingers being made of a suitable elastic material, usually a precious metal alloy, so as to be individually movable, and being mounted and seated at their rearward ends in common mounting means leading to the tap. It is also possible to punch the individual slider fingers from a corresponding flat sheet metal piece. The slider contact area being in direct contact, under spring pressure, with the path or runway is formed in this case by bending off the end of each slider finger in a suitable manner, for example at a right angle so as to form an end hook or sort of a claw.

The state of the prior art appears in detail from the representation shown in FIG. 1 to which we will also refer hereafter in explaining the problems connected with such taps or current collectors. The following explanations relate in particular to the design of a tap for a so-called displacement pick-up which usually consists of a linear potentiometer of sometimes quite considerable length (up to 2 m) and is used as an actual value pick-up on moving machine parts. The demands placed upon such linear displacement pick-ups, in particular when used on high-speed machines, for example in the plastic injection molding field, are extremely high in that the slider is guided at extremely high speeds over the central runway areas (to give a numerical figure, a speed of, say, 10 kms/hour may be considered as a mean value), while at the two end points the slider is reversed abruptly and moved in the opposite direction and, thus, subjected to considerable acceleration forces. Still, it must be ensured that an absolutely perfect voltage signal is provided by the displacement pick-up under all conditions and even in applications where several hundred or thousand million cycles are to be performed. It should be noted in this connection that the following consideration of the prior art refers to a preferred domain of application of such high-precision potentiometers or displacement pick-ups as actual value pick-ups for linear displacements, it being however understood, that the discussed pick-ups are of course not restricted to this application but can be used with advantage in all cases where similar problems are encountered at points where currents or voltages are to be transferred from stationary parts to rotating or moving elements.

In FIG. 1, which represents the state of the prior art, the tap which is indicated generally by reference numeral 10 comprises a block 11 which in the embodiment shown stands for all possible or imaginable mounting forms and which may be driven by any machine component whose actual value variation is to be transformed into a highly precise voltage signal, and further the slider element as such which in the embodiment shown comprises a plurality of slider fingers 12 which are made from a suitable precious metal alloy and which are arranged in a row one beside the other and mounted at 13 on the block 11. The resistance path whose potential is to be picked up by the tap during its movement and is usually to be transmitted to a parallel collector or return path, is designated by 14. The individual slider fingers 12 which may be arranged one beside the other at small relative distances and designed similarly to the design and arrangement shown in FIG. 3, are bent off at 15 so as to form a hook-shaped contact area, i.e. the slider contact area proper which is designated by 16 and has its lower face in sliding contact with the resistance path. If one supposes that the tap 10 moves initially at a comparatively high speed in the direction indicated by arrow A up to a pre-determined reversal point which may be formed for example by the position of the tap shown in FIG. 1, that it is then reversed abruptly and at extreme acceleration and moved in the opposite direction indicated by arrow B, then the slider element will at the moment where it is subjected to the said extremely high acceleration tend or at least try to lift off the runway or path in the direction indicated by arrow C, against its inherent elastic spring pressure, simply due to the mass and inertia forces acting upon the slider element. This is of course a very quick dynamical process which suffers, however, from an additional disadvantage due to the necessarily unsymmetrical mounting of the slider element relative to the two directions of movement A and B, which disadvantage occurs when the tap is reversed, at extreme acceleration, at the other reversal point from the direction of motion B into the direction of motion A. For now the slider element will, again due to the mass or inertia moments and here even assisted by the resilient effect of the slider element itself, try to "dig" itself into the path in the direction indicated by arrow D represented in dotted lines so that problems will be encountered, exactly at the reversing points of the tapping motion, in providing a true and faultless picture and representation of the tapped voltages.

On the other hand, however, the reversing points are exactly those points at which a particularly true picture of the tap signals is absolutely mandatory, if one thinks only of the application of such displacement pick-ups in plastic processing machinery, i.e. injection molding machines or the like. Such plastic injection molding machines use for example machine elements and/or molds which approach each other at considerable speed so that the exact representation of their actual values is of greatest importance if the machines are to operate properly and without damage. In the case of closing molding heads or mold halves of plastic injection molding machines the material is injected at the very last moment, directly before the reversal points, where high pressures are encountered and the dies are practically in contact with each other, and it is exactly at these moments that it must be possible to determine the actual position of the dies with extreme accuracy.

Other peripheral problems in the known taps are due, for example, to the fact that in order to obtain the necessary spring pressure of the slider element the latter assumes a downwardly concave curved shape—as shown in FIG. 1—which as will be readily understood is the result of the fact that the slider is brought into contact with the runway at the desired pressure while the block 11 is retained in horizontal position. However, due to this bulging of the slider element under the biassing pressure in the operative position, the supporting block 11 must maintain a certain minimum distance—designated by E in FIG. 1—to the runway to prevent the bulged portion from approaching the surface of the resistance path in a dangerous manner, in particular when the end hook 16 moves at low speed. It is, however, desirable to keep the distance E as small as possible in order to minimize the comparatively high moment which would otherwise develop around the point of contact on the runway due to this distance. This relatively high moment, in combination with the fact that the slider element is pushed in the one, and pulled in the other direction of motion, aggravates the unsymmetrical operation and may reinforce such symptons as the lifting-off tendency, chattering on the runway, irregularities in the transmitted voltage, etc.

Now, it is the object of the present invention to ensure in a tap or current collector of the type described above that a true picture of the tapped voltage potential is obtained without any trouble, even under extreme acceleration effects, that unobjectionable sliding of the tap on the runway, path or collector, or the like is obtained, that no chatter marks are set and that the overturning moments developed are kept as low as possible.

ADVANTAGES OF THE INVENTION

The tap or current collector according to the invention solves this problem by the characterizing features of the main claim and offers the advantage that an absolutely true picture of the actual movement of the respective machine element can be obtained in the form of a voltage potential, and this in particular also at the particularly critical reversal points of the potentiometer or displacement pick-up where a plurality of dynamical effects is active due to the extremely high accelerations encountered. The invention makes it possible on the one hand to control these dynamical effects and/or to eliminate them by mechanical measures, while on the other hand it ensures that perfect electrical pictures of the actual movements of the machine elements are obtained even in the presence of residual dynamical effects.

By providing at least two slider elements for movement in opposite directions, it is ensured that at least one of the slider elements is pulled, while the other one is pushed at any point of the path, and although both sliders seem practically stationary for a short moment at the two ends or reversal points, they are subjected at those points to completely different dynamical effects, but so that at any moment one of the said slider elements is in a position to deliver the desired actual value voltage in a faultless and troublefree manner.

Another particular advantage of the present invention resides in the fact that the novel shape and design of the tap or current collector permits working cycles of several hundred or thousand millions, i.e. a number which heretofore was felt to be absolutely unimaginable. Similarly, the tap of the invention can stand speeds and accelerations which in the case of the former taps would have led to complete destruction within a few hours.

The features specified in the subclaims permit advantageous developments and improvements of the tap or current collector described by the main claim. A particularly advantageous arrangement is provided by the unbiassed, bent-off shape of the individual slider elements in the inoperative position, i.e. when they are not in sliding contact with the associated runway. Due to the characteristic bent shape which the slider assumes in the inoperative position, when the continuing elastic contact force is exerted upon the individual longitudinal partial elements $\sigma 1$ of the slider, a force is obtained which altogether causes the slider elements in the installed condition of the tap to assume a practically perfectly straight shape from their mounting points to their bent-off end hooks, which permits to arrange the tap at a considerably smaller distance from the resistance path, to drastically reduce the mounting distance which tends to create overturning moments, oscillations, digging-in or braking tendencies or increased frictional losses, and to apply those sliding forces which finally act in the contact area between the end hook and the resistance path at a point as close as possible to the latter. Long-time tests have shown that this permits to control many oscillation problems and dynamical effects which heretofore have led to serious damage.

DRAWING

Certain embodiments of the invention will be described hereafter in detail with reference to the drawing in which.

DESCRIPTION OF THE EMBODIMENTS

The basic idea of the present invention is to be seen in the fact that the tap is given such a design that, irrespective of the sense of movement of the tap along the associated contact path, one slider element will always be pulled while another one will always be pushed simultaneously by its mounting means whereby full compensation of the before-mentioned dynamical effects is achieved.

Figure 1:
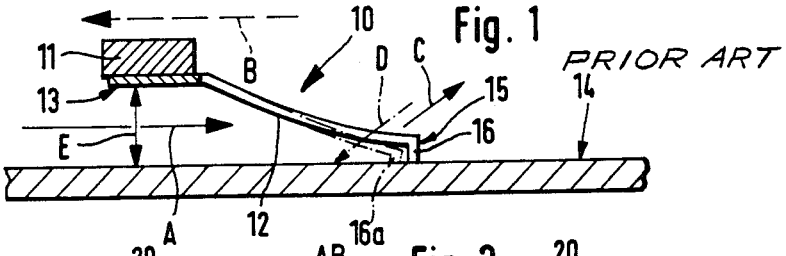
Fig. 1 PRIOR ART
FIG. 1 shows a diagrammatic partial section through one embodiment of a tap representing the state of the art.
Figure 2:
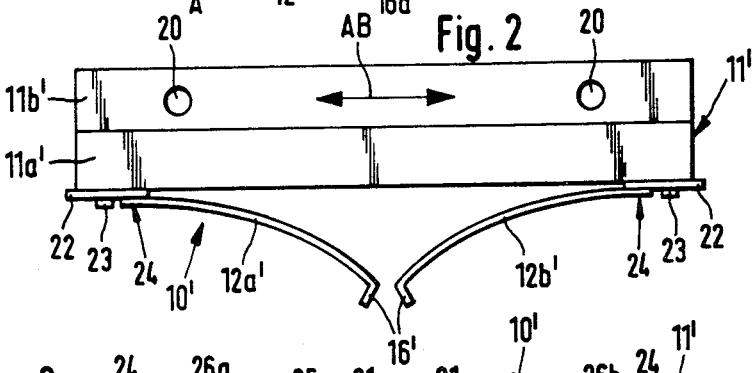
FIG. 2 is a side view of one embodiment of the present invention.
Figure 3:
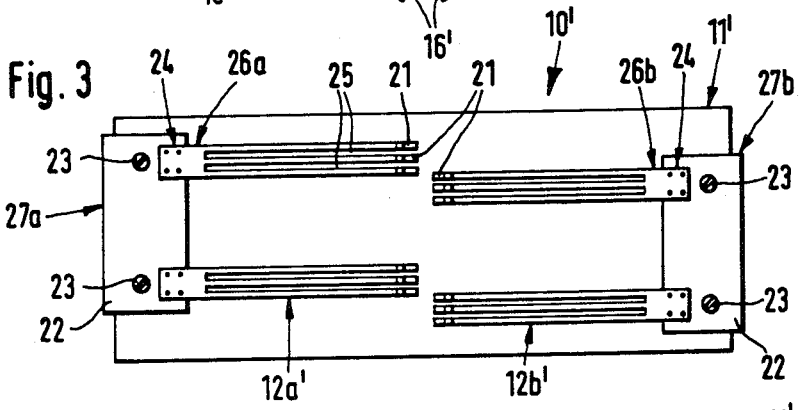
FIG. 3 shows a bottom view of the embodiment of FIG. 2, the sliding elements being shown in both cases in the unmounted inoperative condition.
Figure 4:
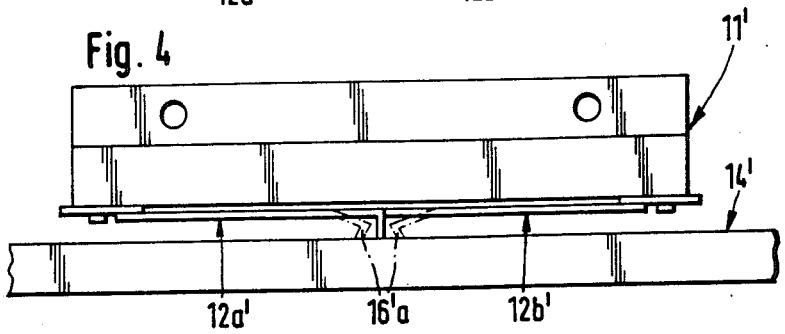
FIG. 4 shows the tap of the invention with its slider elements in the installed condition in which the end hooks of the sliders contact the runway under pressure.

In FIGS. 2 to 4, partial components and elements identical to those shown in FIG. 1 are identified by identical reference numerals supplemented, however, by an apostrophe.

In the embodiment of a tap 10' shown in FIGS. 2 and 3, the block in which the tap and/or slider components are mounted is designated by 11'. It exhibits a greater length in the longitudinal direction of the tapping movement and may consist of a bottom part **11*a'* and a mounting part 11*b'* extending at a right angle thereto and provided with mounting bores 20**. For definition purposes it should be noted that the term tap as used hereafter will mean the whole movable element, including the mounting block, which is displaced along the resistance path or the element to be contacted.

The mounting block 11' then carries individual slider elements **12*a'* and 12*b'* which are formed in turn by individual slider fingers the end portions of which are united usually to form one single piece. Collectively, the slider fingers are indicated by the reference numeral 21 (see FIG. 3**).

As can be seen from FIG. 2, the design of the tap of the invention is such that, regarding initially only the means for scanning an imaginary resistance path, at least two slider elements **12*a'*, 12*b'* are provided which are oppositely mounted or arranged to move in opposite directions. A practical example will be described further below with reference to FIG. 3. More specifically, the two slider elements 12*a'*, 12*b'* are mounted in such a manner that in the installed condition they contact a common transverse line, relative to the usual sense of movement, on the resistance path or other runway or collector, a condition which must necessarily be fulfilled to ensure that the same potential is picked up by the slider elements 12a', 12b'. Accordingly, the mounting points of the slider elements of the embodiment shown in FIG. 2 face in opposite directions and are spaced by a given distance in the direction of displacement although the sliding faces of the end hooks are disposed on a common line. If the representation shown in FIG. 2 looks different, this is due to the fact that FIG. 2** shows a tap or current collector in the inoperative condition, i.e. in the unmounted position, in which yet another inventive feature is realized which will be described in detail further below.

In any case, the two slider elements 12a', 12b' facing each other are mounted on the—preferably common—mounting block 11' in such a manner that irrespective of the sense of movement of the tap along the double arrow AB, one of the slider elements 12a', 12b' will always be pulled, while the other one will always be pushed, relative to the respective mounting points. Mounting may be effected in the manner shown in FIG. 2 where a mounting plate 22 is provided for each slider element and fastened by means of two screws 23 (see also FIG. 3) to the base plate 11a' of the mounting block 11', the integrally punched common end piece of each slider element being fastened to the said plate for example by spot welding, as shown at 24. The reason for mounting each slider element 12a', 12b' separately on an additional carrier plate is to be seen mainly in that the individual slider fingers 21 of the slider elements are made from an expensive precious metal alloy consisting mainly of palladium, platinum, silver and gold (technical designation: Paliney No. 6 or 7).

The individual slider elements 12a', 12b' are punched out from narrow strips of the alloy in such a manner that the cuts forming the recesses 25 between the slider fingers 21 extend relatively close to the area 24 by which the element is mounted on the carrier plate 22 so that each slider finger is permitted to react resiliently and elastically, independently of the other slider fingers.

At the other end portion, a small residual piece is bent off at about a right angle so as to form sort of a claw or end hook 16 whose lower face is intended to slide on the associated runway. Considering that this sliding face is of uniform nature throughout the full cross-section, a certain wear can be accepted without having to put up with relevant variations of the measured values. At the same time, the free spaces formed between the individual slider fingers by the recesses 25 prevent loose material or dust from lifting the contact faces of the slider fingers off the runway because such material can be pushed to the side.

In FIG. 3, one clearly sees the parallel arrangement of the individual slider fingers 21 of each slider element 12a', 12b'. In the embodiment shown, there are provided two additional slider elements 26a, 26b which may be mounted in the same manner on the same electrically conductive carrier plate 22 and which may thus form the sliders for the return runway or collector path extending in parallel to the resistance path when the invention is realized as a linear displacement pick-up. Besides, the mounting block 11' on which the oppositely arranged two slider halves 27a, 27b are mounted in accordance with FIG. 3, need not necessarily be electrically conductive and may, accordingly, consist of a suitable plastic material or the like because the slider elements 26a, 26b for the return runway have the contact faces of their end hooks 16' likewise in contact with a common point of the return runway so that the (identical) voltage potential supplied by the two resistance path slider elements 12a', 12b' can be tapped in the parallel connection of the two slider elements at the connection to the return runway.

It has been explained before that the bent shape of the individual slider fingers obtained due to the required elasticity and spring rate of the individual slider elements and necessary for the purpose of obtaining the required contact pressure of the slider face of the end hook 16 is rather disadvantageous as regards the mounting and distance from the resistance path, and also as regards the dynamical effects resulting from this unfavorable bent shape in the mounted operative condition.

In a preferred embodiment of the present invention, the individual slider fingers and, thus, all parallel slider fingers in their entirety, are therefore pre-bent in a curved shape in their inoperative condition, as shown in a possibly somewhat exaggerated manner in FIG. 2, so that they give a concave, i.e. upwardly bulged appearance relative to the resistance path on which they are to slide later.

Now, when such a tap using the configuration of the slider elements shown in FIG. 2 is applied to the resistance path, as shown in FIG. 4, the contact pressure will cause the individual slider element to assume a substantially perfectly straight shape so that as a result thereof the whole tap, and also the mounting block 11', can be placed very close to the resistance path 14' or any other part to be contacted, overturning moments can be avoided, and the slider elements are pulled practically at the point at which they are braked by the sliding contact with the surface of the resistance path 14'—if one disregards the extremely small distance of the end hook which is shown in an exaggerated manner in the drawing, so that altogether a smoothing and balancing effect can be exerted on the dynamical tapping operation and the inertia and/or mass effects which in the tap of the prior art (FIG. 1) are encountered each time the tap is reversed, are of course also reduced.

Besides, it is also apparent that when the tap is applied to the resistance path, the bent shape which the slider elements 12a', 12b' assume in the inoperative condition is reversed in such a manner that, provided of course the distances have been adjusted accordingly, the end hooks 16' assume absolutely coinciding positions on the runway, as shown in FIG. 4.

In order to adjust the distance of the two slider parts 27a and 27b relative to each other a device comprising a transparent face is pressed against the bottom faces of the slider elements, before the latter are mounted, until the desired distance between the tap and the resistance runway is obtained, whereupon one of the slider parts 27a or 27b is adjusted in the axial direction by means of the mounting screws 23 until coincidence is achieved between the bent-off end hooks 16' of all slider elements.

A still further advantageous improvement of the present invention provides that the individual slider fingers which are pressed resiliently against the runway are provided with a common coating or covering of an elastomer or silicone rubber, in any case of a rubber-like material with internal friction, covering them jointly on at least one side, so that while the independent free spring movement of each individual slider finger is still possible, the other fingers and the action of the elastomer itself provide a damping effect so that in any case no resonances and/or jumping or chattering of the slider fingers will occur.

Still another particularly advantageous feature of the invention consists in the following: When regarding initially the prior art as represented by FIG. 1, it is clear that due to the progressive wear of the end portion of the end hook 16 sliding on the runway the tapping point on the resistance path will of course be displaced, as is indicated by the dotted lines at 16' in FIG. 1. In contrast, any falsification of the measured values due to wear is excluded by the double slider design of the invention due to the fact that although a certain wear of the end portions of the hooks 16*a* can of course not be excluded by the double slider design of the invention, the worn sliders will, however, displace in opposite directions so that the voltage tapping point will not vary in the average. It must of cours be noted that the representation of the conditions just described and given at 16'*a* in FIGS. 1 and 4 is of course exaggerated for the purpose of facilitating the understanding.

All features mentioned in the specification and the following claims and shown in the drawings may be essential to the invention either alone or in an desired combination thereof.

I claim:

1. A tap for potentiometer having a resistance path lying in a preselected plane and adapted to carry an electric signal, and collector means; comprising first and second slider elements adapted to be connected to the same collector means, each of said first and second slider elements having at least one slider finger having contact points at the respective ends thereof, and a common slider carrier mounting both slider elements relative to each other in such a manner that one of said fingers is pulled while the other is pushed in response to the movement of said slider carrier in either direction whereby both slider elements are adapted to connect the resistance path to the same collector means when they are in contact therewith, the improvement comprising prebending the respective fingers of each slider element in such a manner that when the height of the slide carrier is adjusted to a given value above the plane of a resistance path the contact points of all the fingers lie on a common line, so that the influence of any dynamical effects encountered at the reversing points of the path of movement of the tap on a detected electrical signal on the resistance path will be compensated for.

2. A tap according to claim 1, characterized in that each slider element has a pre-determined number of parallel, spring-elastic fingers having bent-off end hooks, all end hooks of both sliders being in coinciding sliding position to the others when in contact with the resistance path.

3. A tap according to claim 2, characterized in that at least the first and second slider elements are mounted on a block preferably formed as one piece and disposed in sliding relation relative to the resistance path so that their respective ends opposite the end hooks of the individual slider fingers face away from each other, whereby the end hooks of said slider fingers are positioned opposite each other.

4. A tap according to claim 3, characterized in that said first and second slider elements comprise a plurality of pairs of slider elements, each of said pair of elements being mounted on said mounting block in an electrically conductive manner, said other pair of said sliding elements being arranged oppositely.

5. A tap according to claim 4, wherein said slider element has an integrally formed end portion, characterized in that there is provided for each pair of slider elements a common carrier plate to which the integrally formed end portions of the individual slider elements are connected, at least one of said carrier plates being fixed to said mounting block by detachable mounting means to permit axial adjustment thereof.

6. A tap according to claim 2, characterized in that each slider element consists of an oblong piece of precious metal from which the individual slider fingers are punched with spaces formed between them, whereby each slider finger can react resiliently, independently of the other slider fingers.

7. A tap according to claim 2, characterized in that in the unstressed inoperative condition, the individual slider elements form a bent shape following a pre-determined curve so that when they are in contact with the associated resistance path the resilient force developed in each slider finger causss the latter to assume a practically straight shape.

8. A tap according to claim 2, characterized in that each end hook has a cross-sectional face, the cross-sectional face of each end hook of each slider finger being of uniform resistivity up to the bent-off area and the transition to the longitudinally extending slider finger so that not even a greater degree of wear will lead to variations in the longitudinal resistance areas swept per pass.

9. A tap according to claim 1, characterized in that the individual slider fingers are covered by an elastomeric material of high internal friction, leaving the contact areas of the slider fingers exposed, so that the relative free mobility of each slider finger is retained by dampened to a considerable degree.

* * * * *